US005628647A

United States Patent [19]

Rohrbaugh et al.

[11] Patent Number: 5,628,647

[45] Date of Patent: May 13, 1997

[54] HIGH FREQUENCY MODULAR PLUG AND CABLE ASSEMBLY

[75] Inventors: Brian Rohrbaugh, Glen Rock; Justin S. Wagner, York; Merv Fair, Glen Rock; Don McClune, York; David Hatch, Glen Rock, all of Pa.

[73] Assignee: Stewart Connector Systems, Inc., Glen Rock, Pa.

[21] Appl. No.: 392,060

[22] Filed: Feb. 22, 1995

[51] Int. Cl.[6] ..... H01R 4/24

[52] U.S. Cl. ..... 439/404; 439/941

[58] Field of Search ..... 439/894, 607, 439/395–404, 417–419, 405, 941

[56] References Cited

U.S. PATENT DOCUMENTS 4,054,350 10/1977 Hardesty ..... 339/99 R
4,160,575 7/1979 Schraut ..... 439/676
5,431,584 7/1995 Ferry ..... 439/894
5,432,484 7/1995 Klas et al. ..... 439/894

*Primary Examiner*—David L. Pirlot
*Attorney, Agent, or Firm*—Steinberg, Raskin & Davidson, P.C.

[57] ABSTRACT

A modular plug and multi-pair cable assembly provides reduced near-end crosstalk between two signal pairs of the cable. A modular plug has a plurality of wire-receiving passages disposed in first and second planar arrays spaced one above the other, with the passages of one planar array being staggered in position with respect to the passages of the other planar array. An end of a first wire of each of two signal pairs is received in respective wire-receiving passages of the first planar array and an end of a second wire of the two signal pairs is received in respective wire-receiving passages of the second planar array. A first pair plane in which the wire ends of the first signal pair are situated intersects a second pair plane in which the wire ends of the second signal pair are situated. In this manner crosstalk between the two signal pairs resulting from magnetic and electric field coupling is reduced.

21 Claims, 7 Drawing Sheets

HIGH FREQUENCY MODULAR PLUG AND CABLE ASSEMBLY

BACKGROUND OF THE INVENTION

This invention relates generally to electrical connector and cable assemblies and, more particularly, to an assembly of a multi-pair cable terminated by a modular plug for use in the transmission of high frequency signals.

Data communication networks are being developed which enable the flow of information to ever greater numbers of users at ever higher transmission rates. A problem is created, however, when data is transmitted at high rates over a plurality of circuits of the type that comprise multi-pair data communication cable. In particular, at high transmission rates, each wiring circuit itself both transmits and receives electromagnetic radiation so that the signals flowing through one circuit or wire pair (the "source circuit") may couple with the signals flowing through another wire pair (the "victim circuit"). The unintended electromagnetic coupling of signals between different pairs of conductors of different electrical circuits is called crosstalk and is a source of interference that often adversely affects the processing of these signals. The problem of crosstalk in information networks increases as the frequency of the transmitted signals increases.

In the case of local area network (LAN) systems employing electrically distinct twisted wire pairs, crosstalk occurs when signal energy inadvertently "crosses" from one signal pair to another. The point at which the signal crosses or couples from one set of wires to another may be 1) within the connector or internal circuitry of the transmitting station, referred to as "near-end crosstalk", 2) within the connector or internal circuitry of the receiving station, referred to as "far-end crosstalk", or 3) within the interconnecting cable.

Near-end crosstalk ("NEXT") is especially troublesome in the case of telecommunication connectors of the type specified in sub-part F of FCC part 68.500, commonly referred to as modular connectors. Such modular connectors include modular plugs and modular jacks. The EIA/TIA (Electronic/Telecommunication Industry Association) of ANSI has promulgated electrical specifications for near-end crosstalk isolation in network connectors to ensure that the connectors themselves do not compromise the overall performance of the unshielded twisted pair interconnect hardware typically used in LAN systems. The EIA/TIA Category 5 electrical specifications specify the minimum near-end crosstalk isolation for connectors used in 100 ohm unshielded twisted pair Ethernet type interconnects at speeds of up to 100 MHz.

A high speed data transmission cable is typically terminated by a modular plug which conventionally comprises an insulating housing in which a planar array of closely spaced parallel passages receive the ends of respective cable wires. The cable typically comprises four circuits defined by eight wires arranged in four twisted pairs and is typically terminated by modular plug having eight contacts engaging the ends of the eight wires, which are received in respective wire-receiving passages arranged in a row. Specified ones of the four pairs of the plug contacts are assigned to terminate respective specified ones of the four cable wire pairs according to ANSI/EIA/TIA standard 568. For example, the standard 568 contact assignment for the wire pair designated #1 are the pair of plug contacts located at the 4–5 contact positions. The cable wires of the pair designated #3 are, according to standard 568, terminated by the plug contacts located at the 3–6 positions which saddle the 4–5 plug contacts that terminate wire pair #1. Near-end crosstalk between wire pairs #1 and #3 during high speed data transmission has been found to be particularly troublesome in modular plugs that terminate cable according to standard 568.

SUMMARY OF THE INVENTION

Accordingly, an object of the present invention is to provide a new and improved cable and connector assembly.

Another object of the present invention is to provide a new and improved modular plug and cable assembly.

Still another object of the present invention is to provide a new and improved modular plug and multi-pair cable assembly for use in the transmission of high frequency signals which provides a significant reduction in near-end crosstalk compared to conventional apparatus.

The present invention is based on the recognition that in a modular plug terminating a multi-pair cable, crosstalk between two pairs of conductors defining different circuits, i.e. between two "signal pairs", results from both magnetic field (inductive) and electric field (capacitive) coupling and that the magnitude of such coupling between the two signal pairs can be reduced by suitably positioning the ends of the signal pairs in the plug and adjusting the spacing between them.

Briefly, as to magnetic field coupling, in accordance with the invention, a modular plug is constructed and the four ends of the two signal pairs are positioned and fixed in the plug such that the signal pins generate signal loops that are oriented at an angle to each other, preferably approaching a right angle. The magnetic field coupling and crosstalk induced between the two signal pairs is thereby reduced compared to the conventional plug construction which requires the signal pins to be positioned in a single row or planar array so that their signal loops are coplanar.

As to electric field coupling, a modular plug according to the invention is constructed to enable the spacing between the signal pins of the signal pairs under consideration to be more evenly balanced. Since the magnitude of the pin-to-pin capacitance is determined solely by the distance between the two signal pins under consideration, the electric field or capacitive coupling and crosstalk induced between the two signal pairs is reduced compared to the conventional plug construction in which the pin-to-pin spacing is less symmetrical.

In a preferred embodiment of the invention, a modular plug includes an insulating or dielectric housing having a plurality of wire-receiving passages disposed in first and second substantially parallel planar arrays spaced one above the other, the passages of the first planar array being staggered in position with respect to the passages of the second planar array. The end of a first wire of each of the first and second wire or signal pairs is received in a respective wire-receiving passage in the first planar array while the end of a second wire of each of the first and second signal pairs is received in a respective wire-receiving passage in the second planar array. The wire-receiving passages in which the wire ends of the first and second wire pairs are received are selected such that the pins of the first signal pair are situated in a first pair plane and the pins of the second signal pair are situated in a second pair plane that intersects the first pair plane so that the signal loops generated by the signal pairs are oriented at an angle to each other.

The ends of the first signal pair are preferably received in adjacent wire-receiving passages of the first planar array while the ends of the second signal pair received in adjacent wire-receiving passages of the second plane or array contiguous with the two adjacent wire-receiving passages of the first planar array, i.e., one of the passages receiving a respective one of the second wire ends is situated intermediate of the pair of passages receiving the first wire ends. This results in the two pair planes, and therefore the signal loops, being oriented at a substantially right angle to each other minimizing magnetic field coupling and additionally more closely balances the pin-to-pin spacing, and therefore the pin-to-pin capacitances, thereby reducing electric field coupling and capacitively coupled crosstalk.

In a preferred embodiment, the modular plug has eight wire receiving passages and the multiconductor cable includes four signal pairs. The first and second planar arrays each include four of the wire receiving passages, viz., two outer passages and two inner passages. The ends of first wires of two of the wire pairs are received in the two inner passages of the first planar array and the ends of the second wires of the two wire pairs are received in the two inner passages of the second planar array to form intersecting pair planes.

DESCRIPTION OF THE DRAWINGS

A more complete appreciation of the present invention and many of the attendant advantages thereof will be readily understood by reference to the following detailed description when considered in connection with the accompanying drawings in which.

DESCRIPTION OF THE PREFERRED EMBODIMENT

Figure 1:
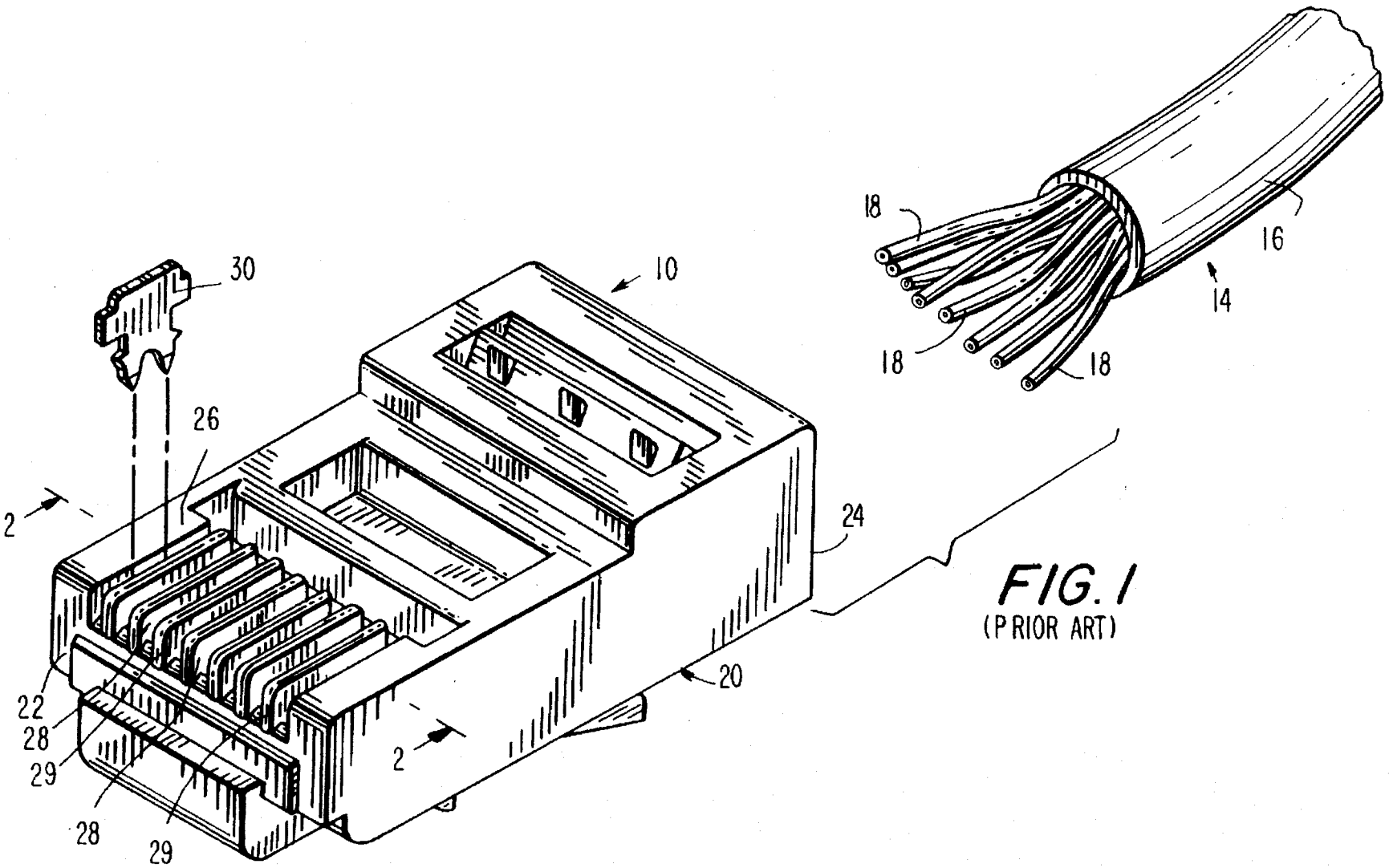
FIG. 1 (PRIOR ART)
FIG. 1 is a perspective view of a conventional modular plug and multi-pair cable prior to termination according to the prior art.

Referring now to the drawings wherein like reference characters designate identical or corresponding parts throughout the several views, the reduction in crosstalk achieved by the invention will initially be described with reference to FIGS. 1–7.

Figure 2:
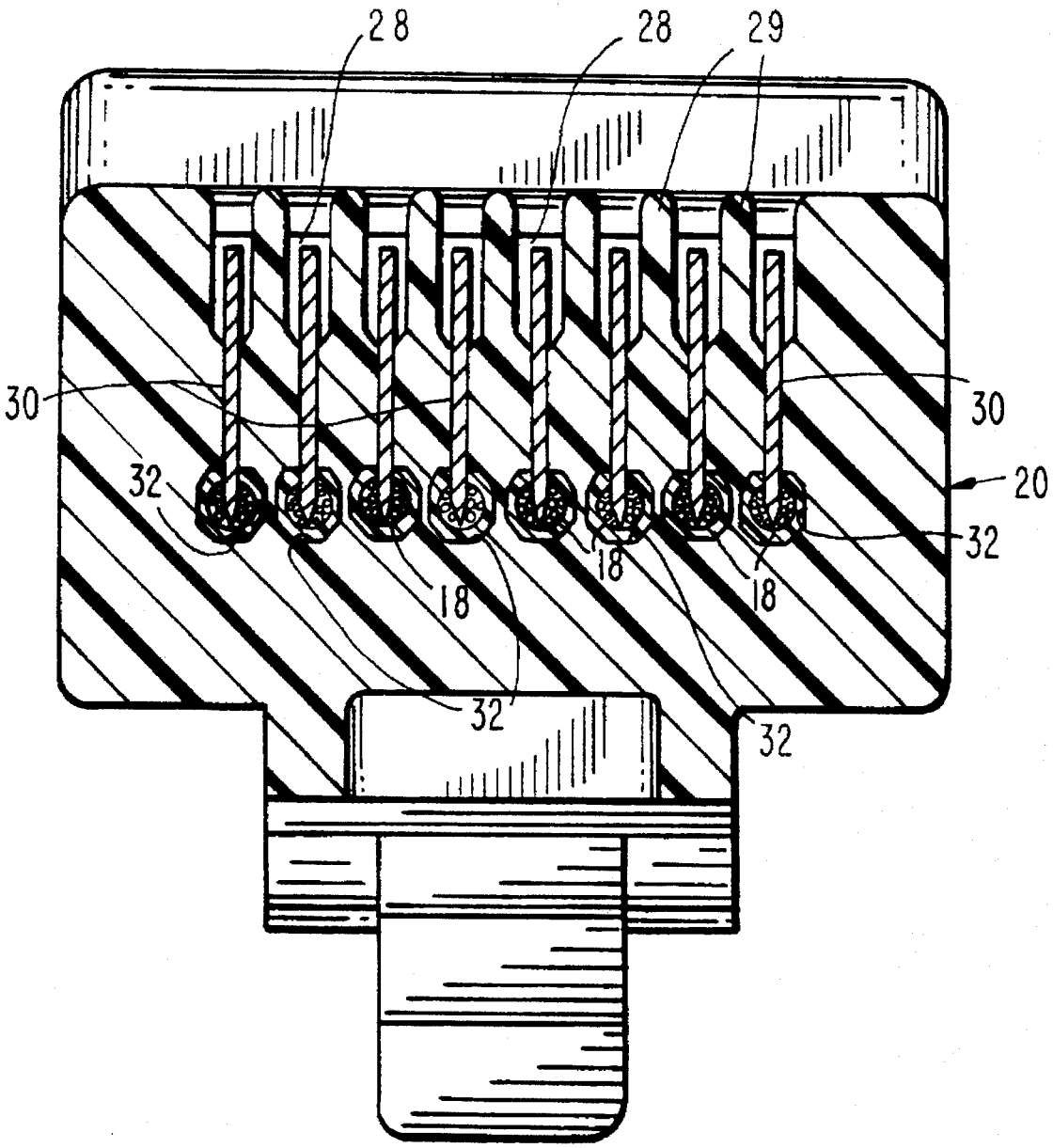
FIG. 2 (PRIOR ART)
FIG. 2 is a transverse cross-section view of the prior art modular plug and cable assembly shown in FIG. 1 taken along line 2—2 of FIG. 1.

Referring to FIGS. 1 and 2, a conventional modular plug 10 for terminating a multi-pair communication cable 14 is illustrated. Cable 14 comprises an insulating sheath 16 enclosing four pairs of conductors or wires 18, each wire pair or signal pair forming a separate signal circuit during use. The construction of plug 10 is well known and generally comprises a dielectric housing 20 having a closed forward free end 22, a cable-receiving rearward end 24, a terminal receiving side 26 and a cable-receiving cavity (not shown) extending longitudinally from the rearward end 24 of housing 20 to a front end. Eight parallel slots 28 defined by corresponding fins 29 open on to the terminal-receiving side 26 of housing 20 for receiving flat contact terminals 30. The eight slots 28 are aligned over a planar array of respective longitudinally extending parallel passages 32 which communicate with the cable-receiving cavity and which receive the ends of respective cable wires 18. Each flat contact terminal 30 is inserted into and fixed within an associated terminal-receiving slot 28 to terminate a respective wire 18 located in a respective wire-receiving passage 32.

Figure 3:
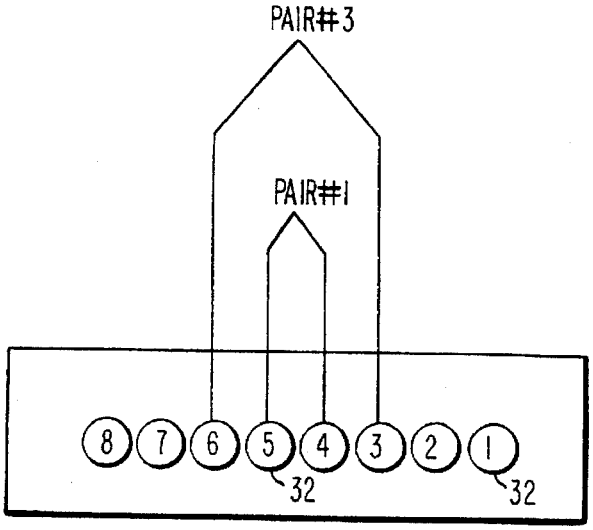
FIG. 3 (PRIOR ART)
FIG. 3 is a schematic illustration of the transverse cross-section of the conventional plug receiving the cable wires corresponding to FIG. 2 and showing the standard terminal assignments for signal pairs #1 and #3.

As noted above, near-end crosstalk between signal pairs #1 and #3 during high speed data transmission has been the most troublesome in modular plugs that terminate cable according to standard 568. Referring to FIG. 3, a schematic illustration similar to FIG. 2 of the transverse cross-section of plug 10 receiving the ends of cable wires 18 shows the conventional planar array of passages 32 in which the wires 18 are inserted, designated by position numbers 1 to 8, and the standard terminal arrangement for signal pairs #1 and #3. As shown in FIG. 3, the ends of wires 18 of signal pair #1 are received in passages 4 and 5 and the wires 18 of signal pair #3 are received in passages designated 3 and 6 which straddle the 4–5 passages that receive the ends of the wires of signal pair 1.

Figure 4:
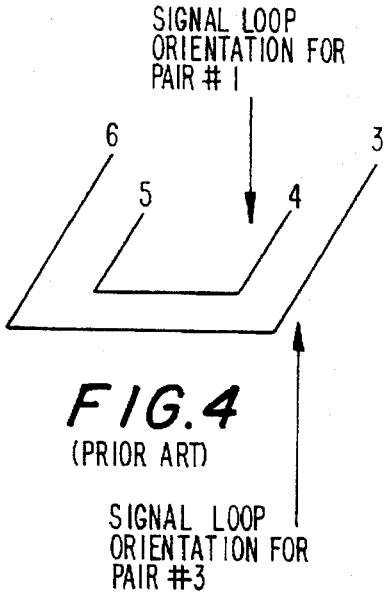
FIG. 4 (PRIOR ART)
FIG. 4 is a schematic illustration of the orientation of the signal loops generated by the signal pairs #1 and #3 of FIG. 1 in the conventional construction.

It has been recognized that as schematically illustrated in FIG. 4, with the ends of signal pairs #1 and #3 in the conventional arrangement of wire passages 32 according to the standard, the signal loop defined by signal pair #1 has an orientation that is co-planar with and which resides entirely within the signal loop defined by signal pair #3 and that such an arrangement maximizes the magnetic field coupling and the resultant crosstalk between these two signal pairs.

Figure 5:
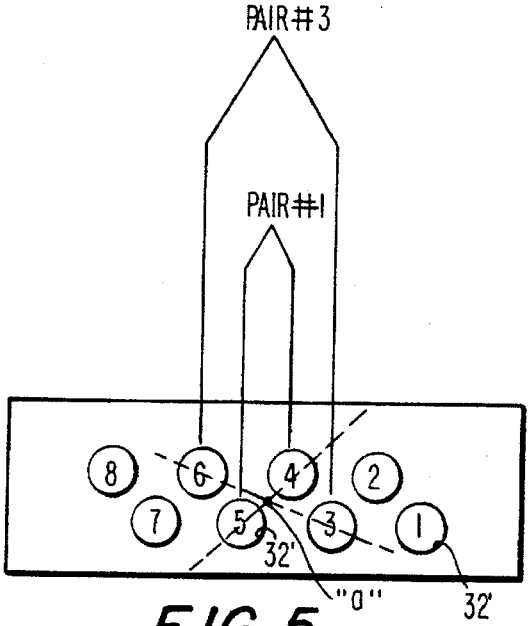
FIG. 5 is a schematic illustration similar to FIG. 3 of the transverse cross-section of a plug receiving cable wires in accordance with the present invention and showing the standard terminal assignments for signal pairs #1 and #3.
Figure 7:
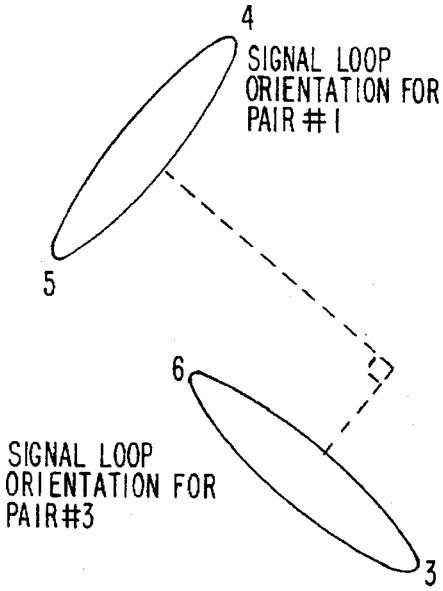
FIG. 7 is a schematic illustration similar to FIG. 4 of the orientation of the signal loops generated by the signal pairs #1 and #3 of the assembly of FIG. 5 and 6 in accordance with the invention.
Figure 6:
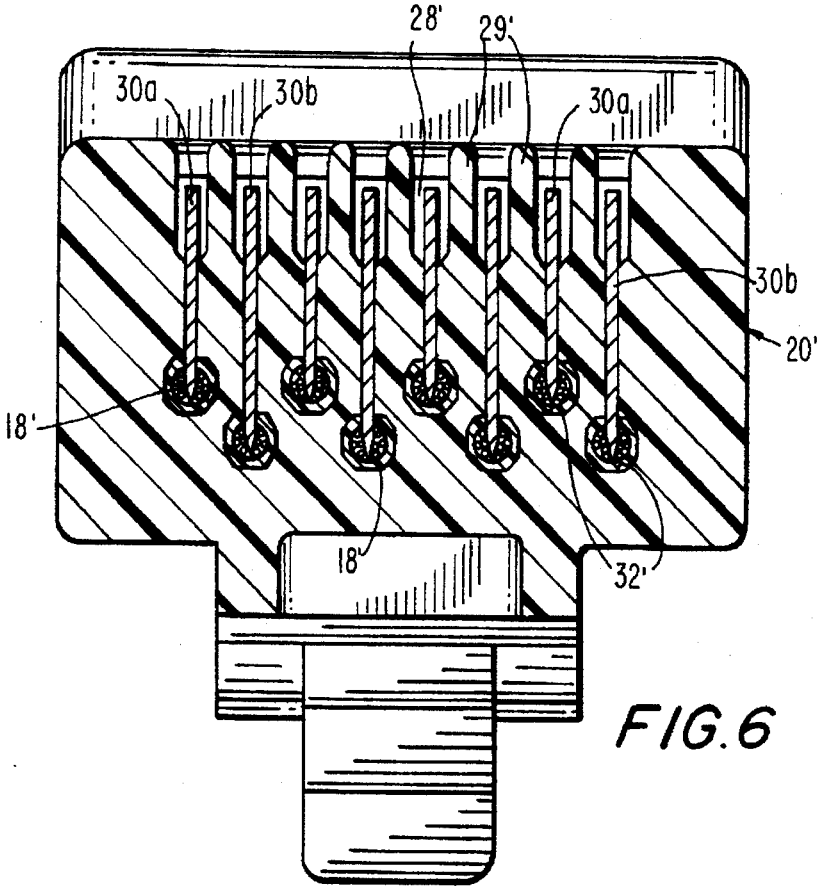
FIG. 6 is a transverse cross-section view similar to FIG. 2 of a modular plug and cable assembly in accordance with the present invention.

Reference will now be made to FIGS. 5–7 in which parts corresponding to parts shown in FIGS. 1–4 are designated by the same reference numerals, primed. In accordance with the invention, in order to reduce the magnetic field coupling and crosstalk induced between two signal pairs, the passages 32' are arranged in a manner such that the signal loops defined by signal pairs #1 and #3 are oriented to occupy pair planes that intersect each other. Specifically, as shown in FIGS. 5 and 6, wire-receiving passages 32' are disposed in first and second substantially parallel planar arrays of four passages each, spaced one above the other, with the passages of the planar arrays being staggered in position with respect to each other.

The cable wires 18' are inserted into passages 32' in accordance with the standard terminal arrangement for signal pairs. Thus, the ends of first wires 18' of signal pairs #1 and #3 are inserted into passages 32' at inner, now laterally adjacent, positions 4 and 6 of the first upper planar array and the ends of the other wires of pairs #1 and #3 are inserted into passages 32' at inner, now laterally adjacent, positions 3 and 5 of the second lower planar array. The pair of upper array passage positions 4, 6 can be said to be "contiguous" to the pair of lower array passage positions 3, 5 since lower position 5 is situated laterally intermediate of upper positions 4, 6. In this standard configuration, the wire ends of signal pairs #1 and #3 form parts of signal loops that lie in pair planes that intersect each other at a point "a" situated between the planes of the first and second planar arrays of passages 32'. Indeed, as schematically shown in FIG. 7, the signal loops lie in pair planes that intersect each other at a substantial right angle, the particular orientation at which magnetic field coupling and crosstalk induced between the two signal pairs is minimized. Although crosstalk resulting from magnetic field coupling is minimized when the pair planes form a substantial right angle with each other, or at least intersect at a point between the planes of the two planar arrays, it will be understood that benefits in accordance with the invention will be obtained so long as the pair planes intersect at some point. This is assured when, with the modular plug oriented such that the first and second planar arrays of wire receiving passages are substantially horizontal, the first pair plane extends upwardly and in one lateral direction while the second pair plane extends upward and in the other lateral direction.

It will also be understood that the present invention does not merely comprise providing a modular plug with a dual array of staggered wire-receiving passages per se. Indeed, such construction per se is shown in the prior art, viz. U.S. Pat. No. 4,054,350. Rather, the invention comprises a combination multi-pair cable and plug assembly wherein the wire ends of two signal pairs are positioned and fixed within the modular plug as described above to reduce magnetic field coupling and crosstalk induced between the two pairs. To applicants' knowledge, this invention is neither taught nor suggested by the prior art.

As noted above, crosstalk in a modular plug also results from electric field or capacitive coupling. In accordance, with the invention, it has been recognized that the magnitude of such coupling between two signal pairs is determined by the degree of symmetry of the distances between the ends of the four wires of those pairs. To simplify the following discussion relating to capacitive coupling, those terminated wire ends of the two signal pairs are referred to as "pins", and the pins of signal pairs #1 and #3 located according to the standard terminal arrangement in wire passages at positions 4, 5 and 3, 6 respectively, are referred to as pin 4, pin 5, pin 3, and pin 6 respectively.

Figure 8:
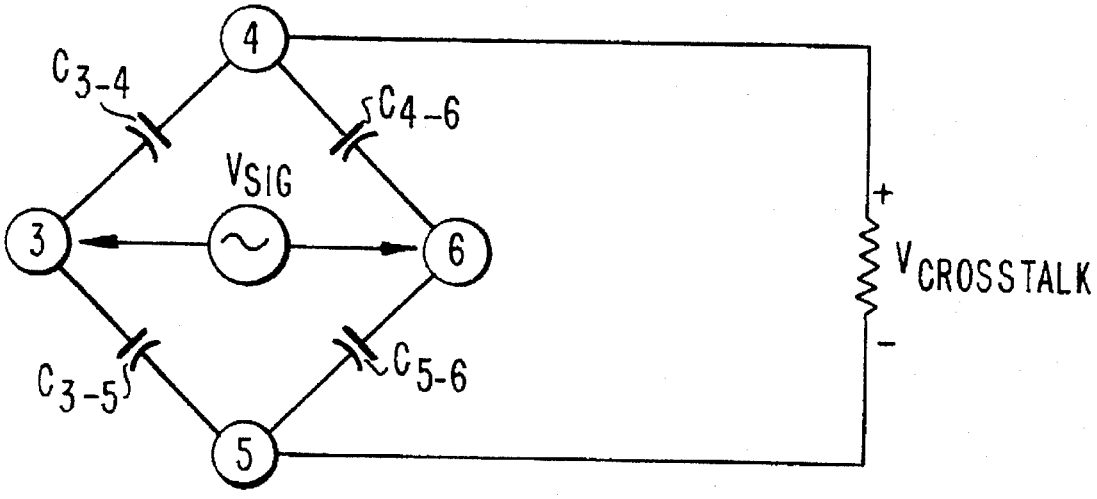
FIG. 8 is a bridge circuit representation schematically illustrating pin-to-pin capacitive coupling between signal pairs #1 and #3 for both the prior art modular plug of FIG. 1 and a modular plug according to the invention of FIG. 3.

FIG. 8 illustrates the dominant pin-to-pin capacitances that exist within both a conventional modular plug as well as in a modular plug constructed in accordance with the invention. The capacitance between pin 3 and pin 6 has been neglected in order to simplify the model. The diamond shaped arrangement shown is often used to represent a balanced bridge type circuit. To illustrate the generation of crosstalk within the plug, a signal source $V_{sig}$ is applied to signal pair number 3 at pin 3 and pin 6.

The magnitude of undesirable capacitive coupling between signal pairs can be estimated by the magnitudes of the capacitances in relation to one another. Since all the pins are identical and parallel, the magnitude of each pin-to-pin capacitance will depend entirely upon the distance between the two pins under consideration. If all pin-to-pin capacitances were equal and the four signal pins corresponding to signal pairs #1 and #3 were arranged in a symmetrical (with identical spacing between nodes) diamond, a near zero capacitive coupling between the two pairs would be expected. Such an arrangement will maintain electrical balance of signal pairs, where each signal pin "sees" the same impedance between itself and every other conductor in the system.

Figure 9:
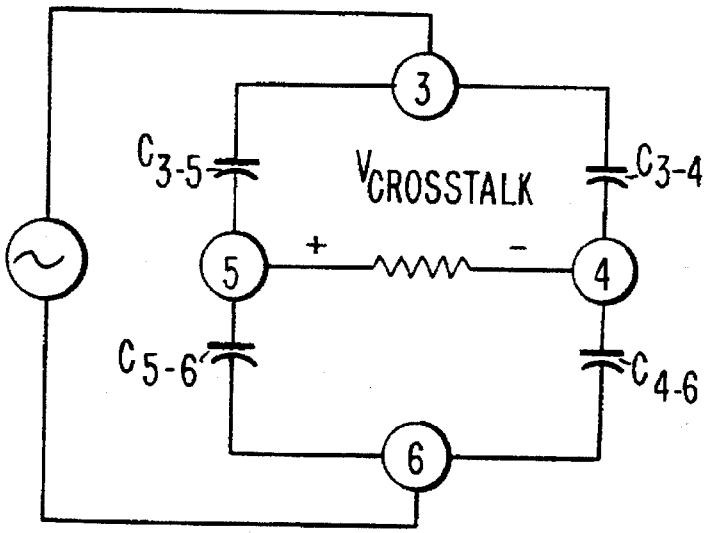
FIG. 9 is a voltage divider representation schematically illustrating pin-to-pin capacitive coupling between signal pairs #1 and #3 for both the prior art modular plug of FIG. 1 and the modular plug according to the invention of FIG. 3.

The maintenance of an electrical balance between signal pairs where each signal pin sees the same impedance between itself and every other conductor in the system can be explained by using a voltage divider model shown in FIG. 9. The capacitively induced crosstalk voltage $V_{crosstalk}$, will be zero if the circuit is perfectly balanced, i.e., if the voltages at pin 5 and pin 6 are made to sum to zero. Viewing each of the two arms of the circuit as a voltage divider, the circuit will be balanced if.

$$\frac{|C_{5\text{-}6}|}{|C_{3\text{-}5}|+|C_{5\text{-}6}|}=\frac{|C_{4\text{-}6}|}{|C_{3\text{-}4}|+|C_{4\text{-}6}|} \quad [1]$$

As noted above, the magnitude of the pin-to-pin capacitances will be determined by the spacing between the pins. The capacitive balance of the standard single row modular plug can be compared to the balance of a dual, staggered row modular plug in accordance with the invention by replacing the subscripts of the pin-to-pin capacitances in formula [1] with the actual pin spacing. A 0.04 inch center-to-center adjacent pin spacing and 0.035 inch center-to-center row height spacing has been chosen, and the equations for a single row conventional modular plug and a dual, staggered row modular plug in accordance with the invention are set forth below in equations 2 and 3 respectively.

$$\frac{|C_{40}|}{|C_{80}|+|C_{40}|}=\frac{|C_{80}|}{|C_{40}|+|C_{80}|} \quad [2]$$

$$\frac{|C_{53}|}{|C_{80}|+|C_{53}|}=\frac{|C_{80}|}{|C_{53}|+|C_{80}|} \quad [3]$$

It is noted that the denominators in equations 2 and 3 are equal and that $C_{80}$ is the right hand side numerator for both expressions. The modular plug according to the invention clearly achieves better balance since $C_{53}$ is closer in value to $C_{80}$ than is $C_{40}$. The decibel improvement in balance can be represented by:

$$= 20 \text{ Log [change in capacitance relative to change for perfect balance]}$$

$$= 20 \text{ Log}\left[\frac{53-40}{40}\right]$$

$$= 2.44 \text{ dB.}$$

Figure 10:
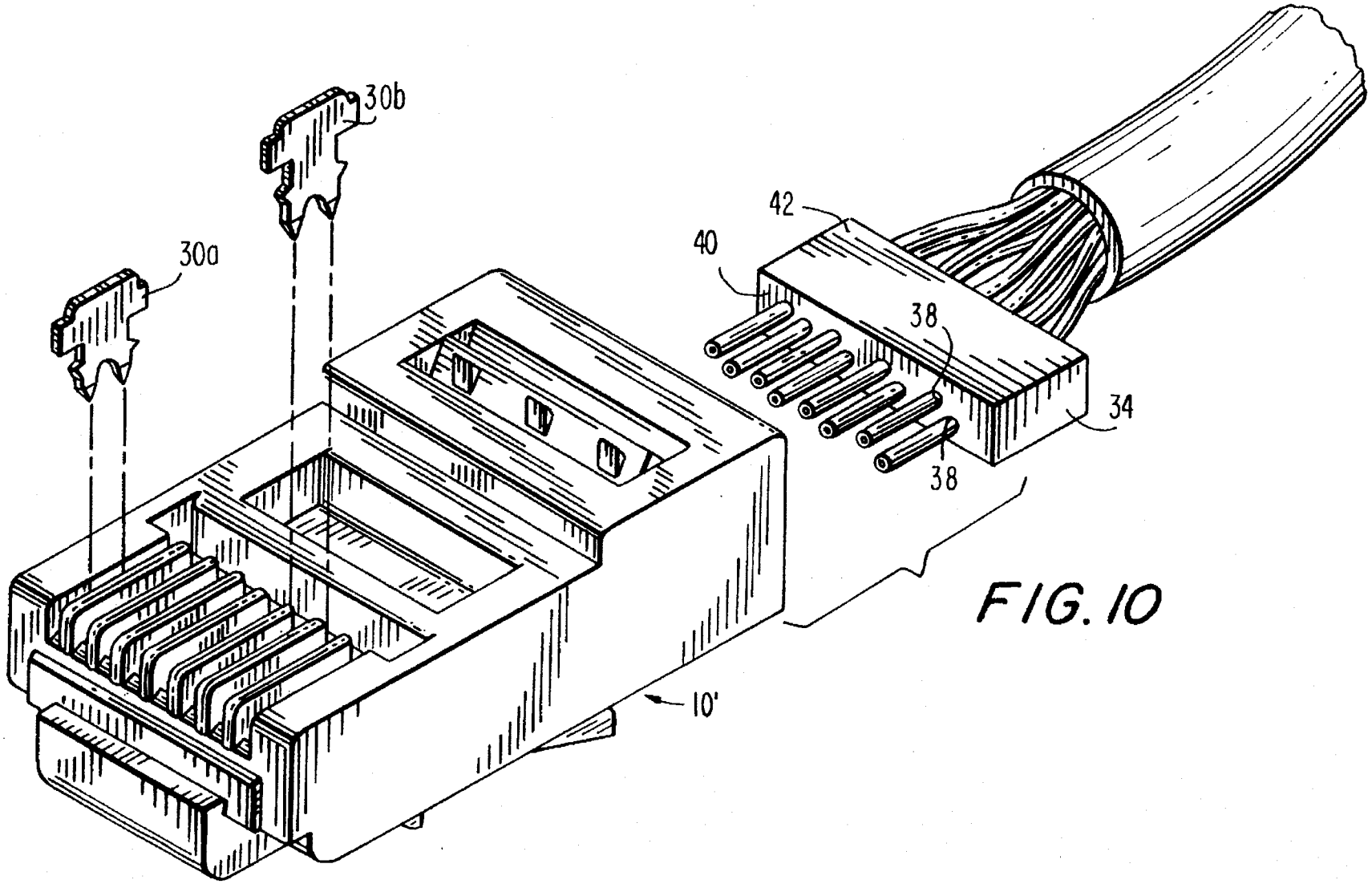
FIG. 10 is a perspective view similar to FIG. 1 of a modular plug and cable assembly in accordance with the present invention prior to connection.

Referring to FIGS. 6 and 10, two sets of contact terminals are required to terminate the wires 18', viz. a set of four shorter terminals **30*a* and a set of four longer terminals 30*b***. The longer contact terminals are situated in respective slots and pass between adjacent wire passages in the first upper planar array to terminate the wire ends received in the wire passages of the second lower planar array.

Figure 11:
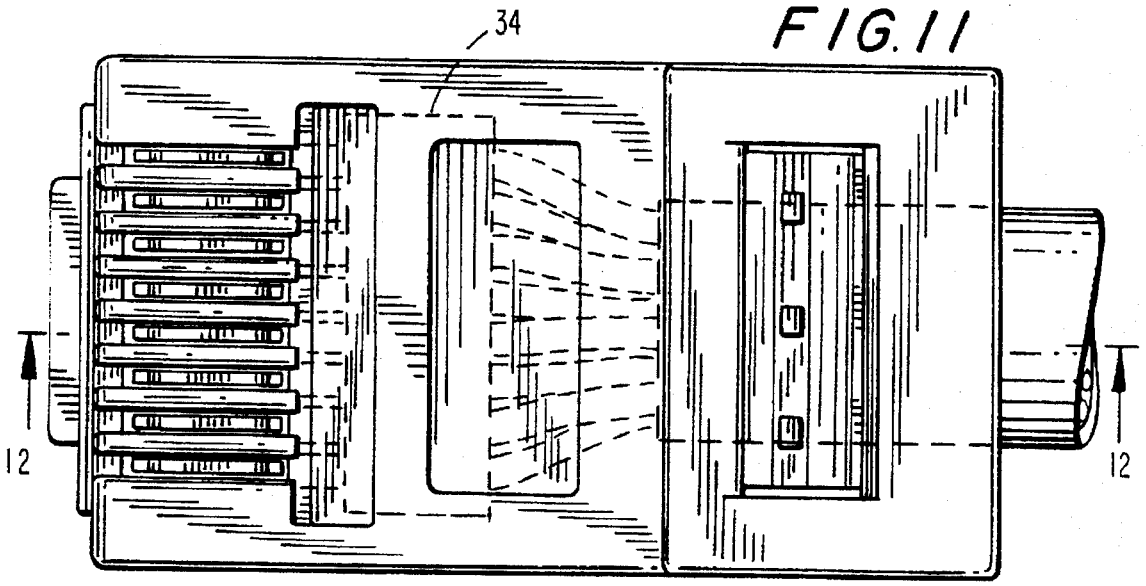
FIG. 11 is a top plan view of the connector-cable assembly of FIG. 10 in accordance with the invention.
Figure 12:
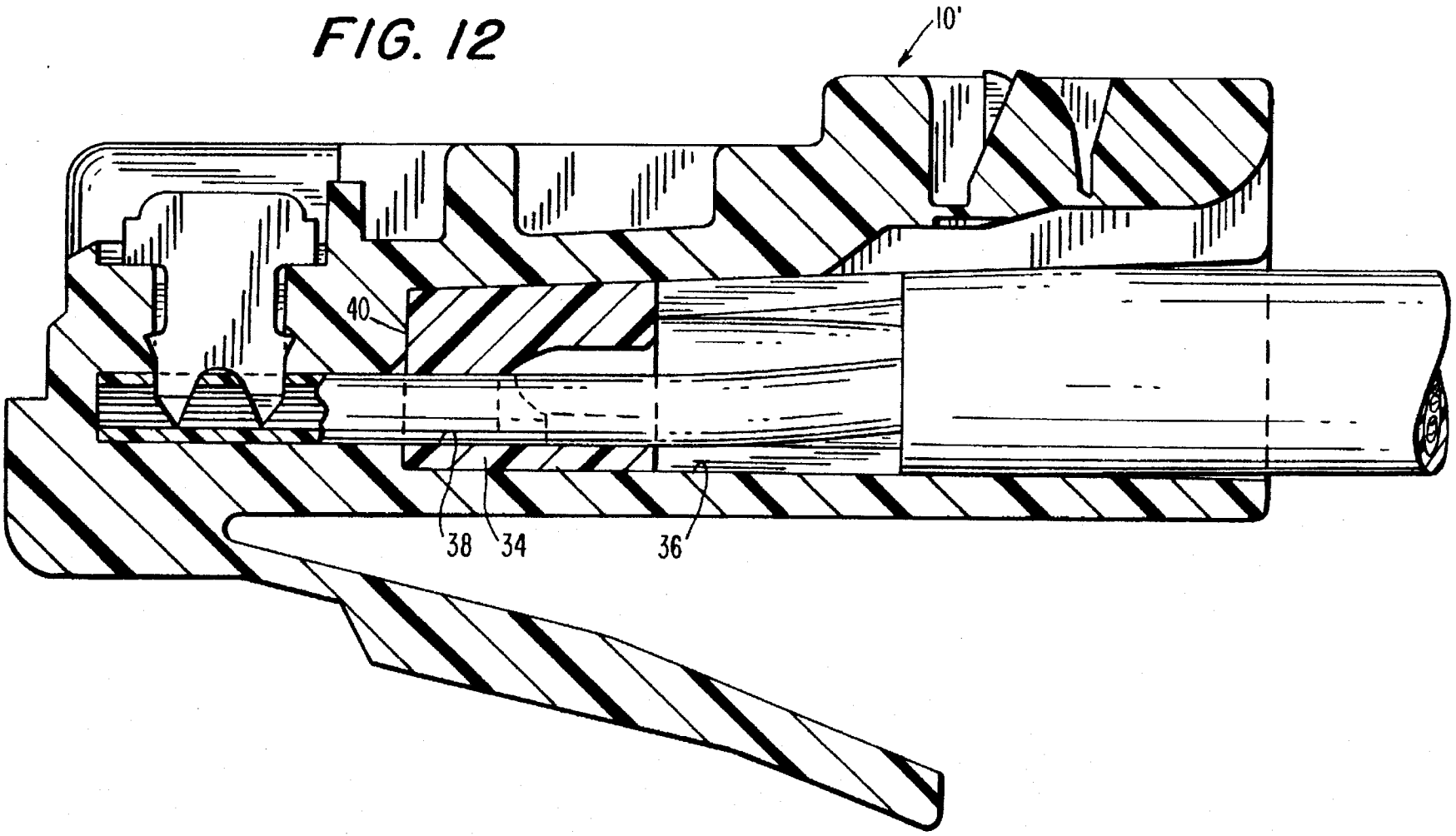
FIG. 12 is a longitudinal section view of the connector-cable assembly taken along line 12—12 of FIG. 11.

Referring to FIG. 10–12 a load or management bar 34 is utilized to facilitate aligning the wire ends with their corresponding wire-receiving passages 32' during the cable insertion step of termination. Management bar 34 comprises a block-shaped plastic member having an outer configuration which corresponds to the shape of the forward end of the cable-receiving cavity 36 (FIG. 12). A pair of planar arrays of four bores 38 each are formed through bar 34 having the same spacing as the dual array arrangement of wire-receiving passages 32'. The diameter of each of the bores 38 is slightly larger than the diameter of the wires 18' to allow for a sliding fit of the wires 18' in bores 38. In assembly, the wires 18' of the four signal pairs are initially inserted into the particular bores 38 of management bar 34 that correspond in location to the positions of passages 32' designated by the standard terminal arrangement. The lengths of the wires 18' that protrude beyond the forward face 40 of bar 34 are sheared flush with the forward face 40 whereupon the wire-carrying bar is inserted into the cable-receiving cavity 36 of plug 10'. The bar is urged forwardly through cavity 36 until its forward face 40 abuts the front end of cavity 36 as seen in FIG. 12. The cable wires are then urged forwardly through bores 38 and pass into the aligned wire-receiving passages 32'. It is understood that the management bar may have other configurations such, for example, as one in which the bores of the upper array are replaced by a planar array of channels that open onto the top surface 42 of bar 34 to facilitate insertion of the wires thereunto.

Obviously, numerous modifications and variations of the present invention are possible in the light of the above teachings. It is therefore to be understood that within the scope of the claims appended hereto, the invention may be practiced otherwise than as specifically disclosed herein.

We claim:

1. An assembly including a multi-conductor cable terminated by a modular plug, comprising:

a multi-conductor cable including at least first, second, third and fourth wires, said first and second wires operatively forming part of a first circuit during use and said third and fourth wires operatively forming part of a second circuit during use;

a modular plug including a dielectric housing having a plurality of wire-receiving passages disposed in first and second substantially parallel planar arrays spaced one above the other, said passages of said first planar array being staggered in position with respect to said passages of said second planar array, and a plurality of parallel contact-receiving slots, each contact-receiving slot communicating with a respective one of said wire-receiving passages;

said cable wires having ends received in respective wire-receiving passages and said modular plug including a plurality of flat contacts, each contact situated in a respective contact-receiving slot and electrically engaging a respective one of said wire ends received in a communicating wire-receiving passage; and wherein an end of said first and third wires being received in a respective wire-receiving passage of said first planar array and an end of said second and fourth wires being received in a respective wire-receiving passage in said second planar array, said wire ends of said first and second wires being situated in a first pair plane and said wire ends of said third and fourth wires being situated in a second pair plane, and wherein said wire ends of said first, second, third and fourth wires are positioned in said wire-receiving passages such that said first and second pair planes intersect each other in order to minimize crosstalk between said first and second wires forming in part said first circuit and said third and fourth wires forming in part said second circuit.

2. An assembly as recited in claim 1 wherein when said modular plug is oriented such that said first and second planar arrays of wire-receiving passages are substantially horizontal, said first pair plane extends upward and in one lateral direction, and said second pair plane extends upward and in another lateral direction.

3. An assembly as recited in claim 1 wherein said first and second pair planes intersect at a point situated between said first and second planar arrays of wire-receiving passages.

4. An assembly as recited in claim 1 wherein said ends of said first and third wires are received in laterally adjacent wire-receiving passages of said first planar array and said ends of said second and fourth wires are received in laterally adjacent wire-receiving passages of said second planar array, and wherein one of said passages receiving said fourth wire end is situated laterally intermediate of said pair of passages receiving said first and third wire ends.

5. An assembly as recited in claim 1 wherein said modular plug has eight wire receiving passages, four of said passages disposed in said first planar array including two outer passages and two inner passages and four of said passages disposed in said second planar array including two outer passages and two inner passages, said multi-conductor cable further including fifth, sixth, seventh and eighth wires, and wherein the ends of said first and third wires are received in said two inner passages of said first planar array and wherein the ends of said second and fourth wires are received in said two inner passages of said second planar array.

6. An assembly as recited in claim 1, wherein said first, second, third and fourth wires are positioned in said wire-receiving passages such that said wire ends of said third and fourth wires are situated intermediate of said wire ends of said first and second wires and a signal loop operatively generated by said first and second wires is oriented at an angle with respect to a signal loop operatively generated by said third and fourth wires.

7. An assembly as recited in claim 1, further comprising a management bar situated at least in part within said plug housing, said management bar having a plurality of wire-receiving bores disposed in first and second substantially parallel planar arrays spaced one above the other, said bores of said first planar array being staggered in position with respect to said bores of said second planar array.

8. An assembly as recited in claim 7, wherein said bores in said first and second planar arrays of said management bar align with said passages in said first and second planar arrays of said housing.

9. An assembly as recited in claim 1, wherein said wire-receiving passages in said first and second planar arrays are structured and arranged such that said pair planes are substantially perpendicular to one another.

10. An assembly as recited in claim 1, further comprising first circuit means for electrically coupling said first and second wires in said first circuit and second circuit means for electrically coupling said third and fourth wires in said second circuit.

11. An assembly including a multi-conductor cable terminated by a modular plug, comprising:

a multi-conductor cable including at least first, second, third and fourth pairs of wires, each wire pair forming part of a respective circuit during use;

a modular plug including a dielectric housing having eight wire-receiving passages disposed in first and second substantially parallel planar arrays spaced one above the other, four of said passages disposed in said first planar array including two outer passages and two inner passages and four of said passages disposed in said second planar array including two outer passages and two inner passages, said passages of said first planar array being staggered in position with respect to said passages of said second planar array, and a plurality of parallel contact-receiving slots, each contact-receiving slot communicating with a respective one of said wire-receiving passages;

said cable wires having ends received in respective wire-receiving passages and said modular plug including a plurality of flat contacts, each contact situated in a respective contact-receiving slot and electrically engaging a respective one of said wire ends received in a communicating wire-receiving passage; and wherein an end of a first wire of each of said first and second wire pairs is received in a respective inner passage of said first planar array and an end of a second wire of each of said first and second wire pairs is received in a respective inner passage in said second planar array, said wire ends of said first pair of wires situated in a first pair plane and said wire ends of said second pair of wires situated in a second pair plane, and wherein said first and second pair planes intersect each other.

12. An assembly as recited in claim 11, wherein when said modular plug is oriented such that said first and second planar arrays of wire-receiving passages are substantially horizontal, said first pair plane extends upward and in one lateral direction, and said second pair plane extends upward and in the other lateral direction.

13. An assembly as recited in claim 11, wherein said wire-receiving passages of said first and second planar arrays are structured and arranged such that said first and second pair planes intersect at a point situated between said first and second planar arrays of wire-receiving passages.

14. An assembly as recited in claim 11, wherein said ends of said first wires are received in laterally adjacent wire-receiving passages of said first planar array and said ends of said second wires are received in laterally adjacent wire-receiving passages of said second planar array, and wherein one of said passages receiving said second wire ends is situated laterally intermediate of said pair of passages receiving said first wire ends.

15. An assembly as recited in claim 11, further comprising a management bar situated at least in part within said plug housing, said management bar having a plurality of wire-receiving bores disposed in first and second substantially parallel planar arrays spaced one above the other, said bores of said first planar array being staggered in position with respect to said bores of said second planar array.

16. An assembly as recited in claim 15, wherein said bores in said first and second planar arrays of said management bar align with said passages in said first and second planar arrays of said housing.

17. An assembly including a multi-conductor cable terminated by a modular plug, comprising:

a multi-conductor cable including at least first and second pairs of wires, each wire pair operatively forming part of a respective circuit during use;

a modular plug including a dielectric housing having a plurality of wire-receiving passages disposed in first and second substantially parallel planar arrays spaced one above the other, said passages of said first planar array being staggered in position with respect to said passages of said second planar array, and a plurality of parallel contact-receiving slots, each contact-receiving slot communicating with a respective one of said wire-receiving passages;

said cable wires having ends received in respective wire-receiving passages and said modular plug including a plurality of flat contacts, each contact situated in a respective contact-receiving slot and electrically engaging a respective one of said wire ends received in a communicating wire-receiving passage; wherein an end of a first wire of each of said first and second wire pairs is received in a respective wire-receiving passage of said first planar array and an end of a second wire of each of said first and second wire pairs is received in a respective wire-receiving passage in said second planar array, said wire ends of said first pair of wires situated in a first pair plane and said wire ends of said second pair of wires situated in a second pair plane, and wherein said first and second pair planes intersect each other; and a management bar situated at least in part within said plug housing, said management bar having a plurality of wire-receiving bores disposed in first and second substantially parallel planar arrays spaced one above the other, said bores of said first planar array being staggered in position with respect to said bores of said second planar array.

18. An assembly as recited in claim 17, wherein said bores in said first and second planar arrays of said management bar align with said passages in said first and second planar arrays of said housing.

19. An assembly as recited in claim 17, wherein when said modular plug is oriented such that said first and second planar arrays of wire-receiving passages are substantially horizontal, said first pair plane extends upward and in one lateral direction, and said second pair plane extends upward and in the other lateral direction.

20. An assembly as recited in claim 17, wherein said first and second pair planes intersect at a point situated between said first and second planar arrays of wire-receiving passages.

21. An assembly as recited in claim 17, wherein said ends of said first wires are received in laterally adjacent wire-receiving passages of said first planar array and said ends of said second wires are received in laterally adjacent wire-receiving passages of said second planar array, and wherein one of said passages receiving said second wire ends is situated laterally intermediate of said pair of passages receiving said first wire ends.

* * * * *